US007559667B2

(12) United States Patent
Holderman

(10) Patent No.: US 7,559,667 B2
(45) Date of Patent: Jul. 14, 2009

(54) LIGHTED CUSHION

(76) Inventor: Dean Alan Holderman, 225 Cramwood Dr., Key Biscayne, FL (US) 33142

( * ) Notice: Subject to any disclaimer, the term of this patent is extended or adjusted under 35 U.S.C. 154(b) by 101 days.

(21) Appl. No.: 11/924,700

(22) Filed: Oct. 26, 2007

(65) Prior Publication Data

US 2009/0109661 A1 Apr. 30, 2009

(51) Int. Cl.
*A47B 23/06* (2006.01)

(52) U.S. Cl. ..... 362/131; 362/127; 297/217.6

(58) Field of Classification Search ..... 362/127, 362/131, 134, 249.05; 297/217.1, 217.6; 108/23; 211/134
See application file for complete search history.

(56) References Cited

U.S. PATENT DOCUMENTS

| | | | | |
|---|---|---|---|---|
| 5,918,932 | A * | 7/1999 | Morrison et al. | 297/217.6 |
| 7,303,304 | B2 * | 12/2007 | Gharabegian | 362/131 |
| 2005/0201080 | A1 * | 9/2005 | Seward | 362/97 |
| 2006/0080780 | A1 * | 4/2006 | Schlieps | 5/657 |
| 2006/0087165 | A1 * | 4/2006 | Gharabegian | 297/217.6 |

* cited by examiner

*Primary Examiner*—Ali Alavi
(74) *Attorney, Agent, or Firm*—Christopher J. VanDam, P.A.

(57) ABSTRACT

A lighted cushion or cushion cover that can be used as a seating cushion on any of a variety of surfaces including chairs, stools, seats, sofas or the like providing the person sitting on surface a cushioned seat and having novelty lighting effects.

15 Claims, 5 Drawing Sheets

LIGHTED CUSHION

BACKGROUND OF THE INVENTION

1. Field of the Invention

The present invention relates to a cushion, and more particularly, to a seating cushion or a cushion cover that emits light.

2. Description of the Related Art

Several designs for lighted seats or cushions have been designed in the past. None of them, however, include lights inside a cushion or cushion cover that can be used with a wide variety of chairs or other furniture.

Applicant believes that the closest reference corresponds to U.S. published patent application No. 2006/0087165 filed by Armen Gharabegian. However, it differs from the present invention because the present invention can be used alone or may be an accessory to compliment a variety of chair designs or other seating structures whereas the Gharabegian device is structurally part of a chair. Therefore, the present invention may be stored and transported easier and can accessorize a wider variety of seats. The present invention also distinguishes itself by using a low-temperature light source eliminating the need for an active cooling means.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a lighted cushion.

It is another object of this invention to provide a lighted seat cushion that may be used with any of a wide variety of seating surfaces.

It is still another object of the present invention to provide a lighted cushion that emits light and provides a cushioning feature.

It is another object of this invention to provide a lighted cushion that is easy to store, transport and use.

It is an object of this invention to provide a lighted cushion cover that may be used with a commonly available cushion.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
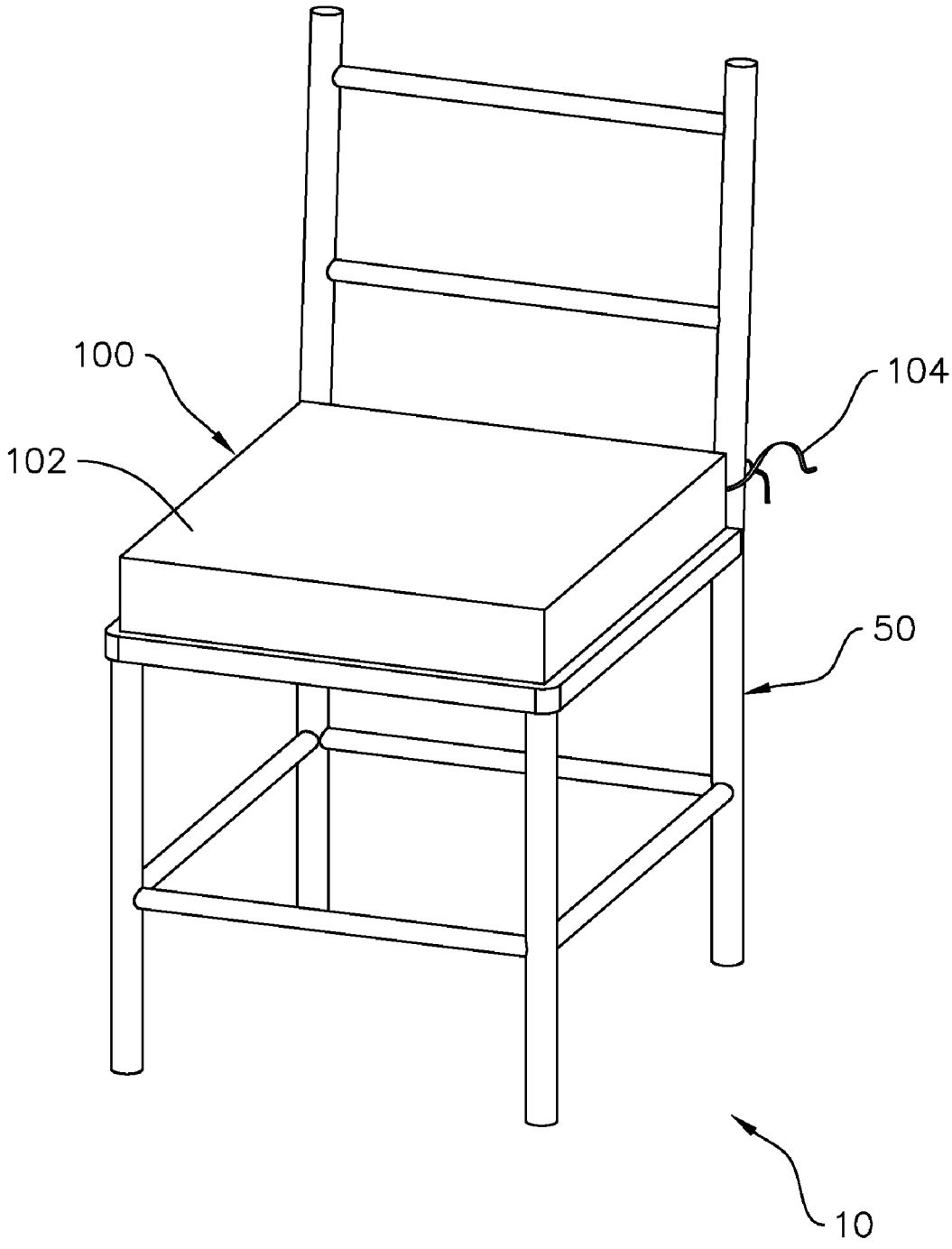
FIG. 1 represents a perspective view of an embodiment of a lighted cushion on the seat of a typical, common chair.

Referring now to the drawings, where the present device is generally referred to with numeral 10, it can be observed that it basically includes a lighted cushion assembly 100 and a common chair 50. In this view a cushion cover 102 and straps 104 are visible on the lighted cushion assembly 100.

Figure 2:
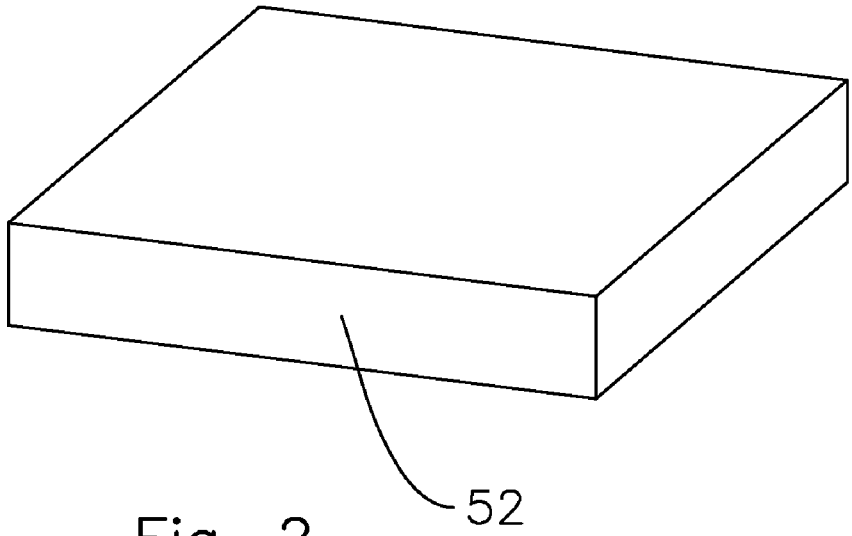
FIG. 2 shows a perspective view of a common chair cushion.
Figure 3:
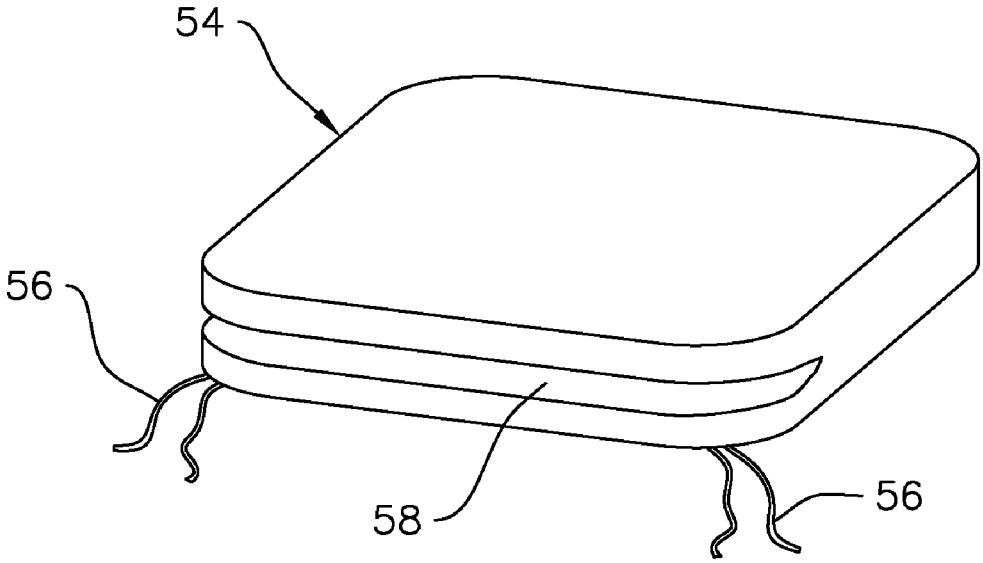
FIG. 3 illustrates a perspective view of a common cushion cover.

Referring to FIGS. 2 and 3 where the current state of the art is depicted comprising of, inter alia, a cushion 52 and a cushion cover assembly 54. Said cushion cover assembly 54 may optionally include straps 56 to secure the cushion cover assembly 54 in place and an opening 58 where a cushion, such as the cushion 52 shown in FIG. 2 or any of the other lighted cushion embodiments described in detail below, may be inserted or removed. Said opening 58 may be optionally closeable by means of a zipper, ties, snaps, clips or other suitable means commonly in use to secure a cushion inside the cushion cover assembly 54.

Said cushion 52 in common use today is often constructed of a single piece of foam or other material with padding properties. Said cushion cover assembly 54 may be made of any of a variety of fabrics, plastic, leather or other synthetic or natural materials. The material of the cushion cover assembly 54 may be selected to achieve a particular effect. For example, the material selected could be clear to show a lighted cushion unobstructed or may have any of a varied degree of opacity to diffuse the light emitted by a lighted cushion contained inside. Optionally the cushion cover assembly 54 may have perforations on the top and/or sides in a pre-selected pattern to permit light emitted from a lighted cushion to shine through more or less brightly through the pattern.

Figure 4:
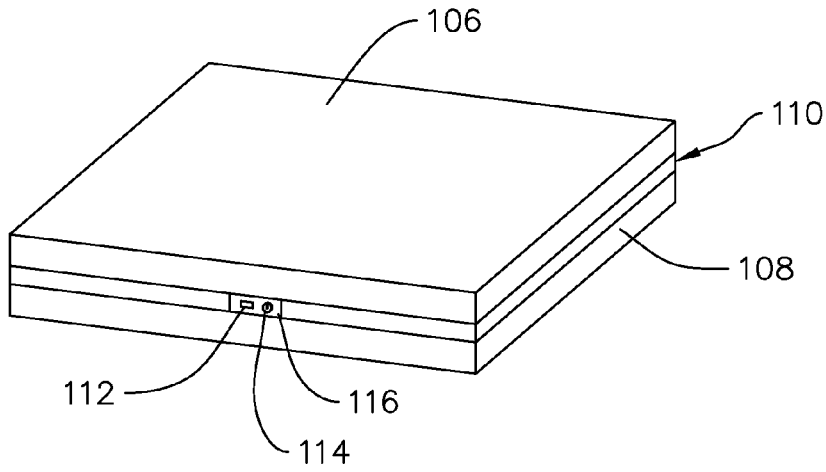
FIG. 4 is a representation of a perspective view of an embodiment of a lighted cushion without a cushion cover.
Figure 5:
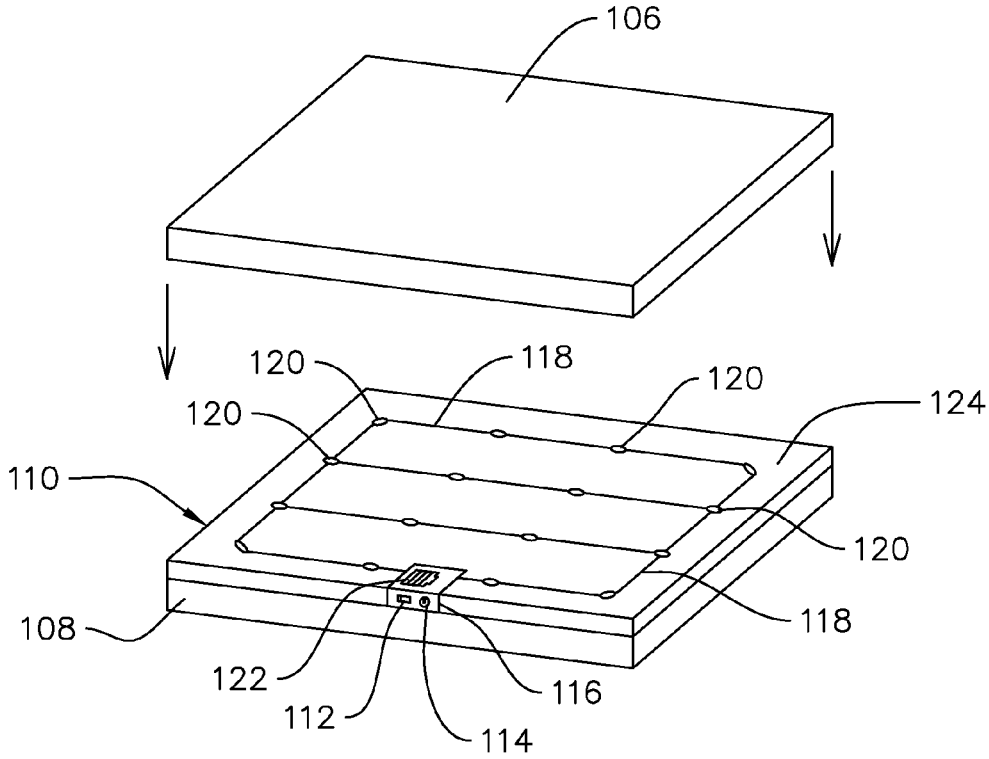
FIG. 5 is an exploded perspective view of the embodiment of a lighted cushion shown in FIG. 4.

Now referring to FIGS. 4 and 5 where an embodiment of a lighted cushion is shown to comprise, inter alia, a pad 106, a pad 108, a light assembly 110, a console 116, a switch 112, switch 114, wires 118, light emitting diodes (LEDs) 120, a battery 122 and a substrate 124. The combination of said pad 106 and pad 108 among the other various components while in use is typically placed on surface intended to be used as a seat and provides, inter alia, a cushioning function. The lighted cushion may be dimensioned to fit onto any shaped seat, for example, rounded for a stool, substantially square for a chair, rectangular to be a couch or bench cushion or any other shape to conform to the dimensions of a surface to be sat upon.

Optionally, the entire lighted cushion shown in FIG. 4 may be placed inside of a cover to protect it. An example of a cover is shown in FIG. 3. If a cover is used it is preferably constructed of a material transparent enough to permit light to pass through it, for example a transparent plastic or thin fabric.

Generally, said light assembly 110 is situated between said pad 108 and pad 106. Said substrate 124 may be constructed from a thin layer of rigid or flexible plastic, paper, encapsulated air cell sheet, gel or similar material that can secure the position of said LEDs 120, wires 118 and console 116 and optionally may provide some degree of cushioning itself.

Said light assembly 110 may be transparent or opaque and may have a reflective coating between the lower pad 108 and the LEDs 120 to reflect any light emitted by the LEDs 120 toward the upper pad 106.

Integral to said light assembly 110 are, inter alia, said LEDs 120, wires 118 and console 116. Said console 116 further comprises a battery 122, switch 112 and switch 114. One or multiple LEDs 120 are affixed to the substrate 124 in a predetermined pattern, for example a grid, concentric rings, lines, arcs, an icon or image or any other two dimensional design. In this embodiment of the light assembly 110 said switch 114 turns the electrical circuit on and off and said switch 112, optionally present, adjustably varies the current passing through the wires 118 and LEDs 120 to produce an effect such as varying the color or intensity of light produced by the LEDs 120, patterns of illumination or other similar effects. Said wires 118 connect the LEDs 120 to each other and to the console 116. Optionally, alternate means to generate light, other than the LEDs 120, may be used and examples could include incandescent lights, florescent lights, phosphorescent lights or any other light technology that is suitable to be used to produce light as a part of the lighted cushion. In some applications of the lighted cushion it may be preferable to substitute said battery 122 with a hard-wired electrical source such as a common household wall power receptacle to avoid the necessity of periodically replacing said battery 122.

Said pad 106 is preferably transparent enough to permit light generated by the LEDs 120 to penetrate and be visible through said pad 106. Said pad 108 may optionally be made of a material that is not transparent to reduce the costs of the pad 108. The combination of pad 106 and pad 108 provide a cushioning function to provide increased comfort to a person sitting on the lighted cushion.

Figure 6:
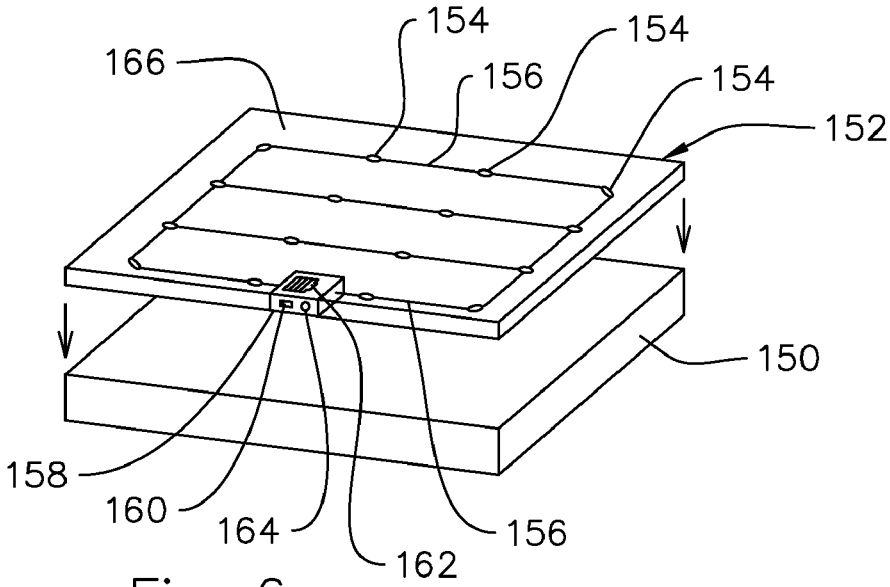
FIG. 6 shows a perspective view of an alternate embodiment of a lighted cushion without a cushion cover.

FIG. 6 demonstrates an embodiment of a lighted cushion comprised of, inter alia, a pad 150, a light assembly 152, light emitting diodes (LEDs) 154, wires 156, a console 158, a switch 160, a battery 162, a switch 164 and a substrate 166. The combination of said pad 150 and light assembly 152, among the other various components, is typically placed on surface intended to be used as a seat and provides, inter alia, a cushioning function. The lighted cushion may be dimensioned to fit onto any shaped seat, for example, rounded for a stool, substantially square for a chair, rectangular to be a couch or bench cushion or any other shape to conform to the dimensions of a surface to be sat upon.

Optionally, the entire lighted cushion shown in FIG. 6 may be placed inside of a cover to protect it. An example of a cover is shown in FIG. 3. If a cover is used it is preferably constructed of a material transparent enough to permit light to pass through it, for example a transparent plastic or thin fabric.

Generally, said light assembly 152 is situated on top of said pad 150. Said substrate 166 may be constructed from a thin layer of rigid or flexible plastic, paper, encapsulated air cell sheet, gel or similar material that can secure the position of said LEDs 154, wires 156 and console 158 and optionally may provide some degree of cushioning itself. Said light assembly 152 may be transparent or opaque and may have a reflective coating between the pad 150 and the LEDs 154 to reflect any light emitted by the LEDs 154 away from the pad 150.

Integral to said light assembly 152 are, inter alia, said LEDs 154, wires 156 and console 158. Said console 158 further comprises a battery 162, switch 164 and switch 160. One or multiple LEDs 154 are affixed to the substrate 166 in a predetermined pattern, for example a grid, concentric rings, arcs, an icon or image or any other two dimensional design. In this embodiment of the light assembly 152 said switch 164 turns the electrical circuit on and off and said switch 160, optionally present, adjustably varies the current passing through the wires 156 and LEDs 154 to produce an effect such as varying the color or intensity of light produced by the LEDs 154, patterns of illumination or other similar effects. Said wires 156 connect the LEDs 154 to each other and to the console 158. Optionally, alternate means to generate light, other than the LEDs 154, may be used and examples could include incandescent lights, florescent lights, phosphorescent lights or any other light technology that is suitable to be used to produce light as a part of the lighted cushion. In some applications of the lighted cushion it may be preferable to substitute said battery 162 with a hard-wired electrical source such as a common household wall power receptacle to avoid the necessity of periodically replacing said battery 162.

Figure 7:
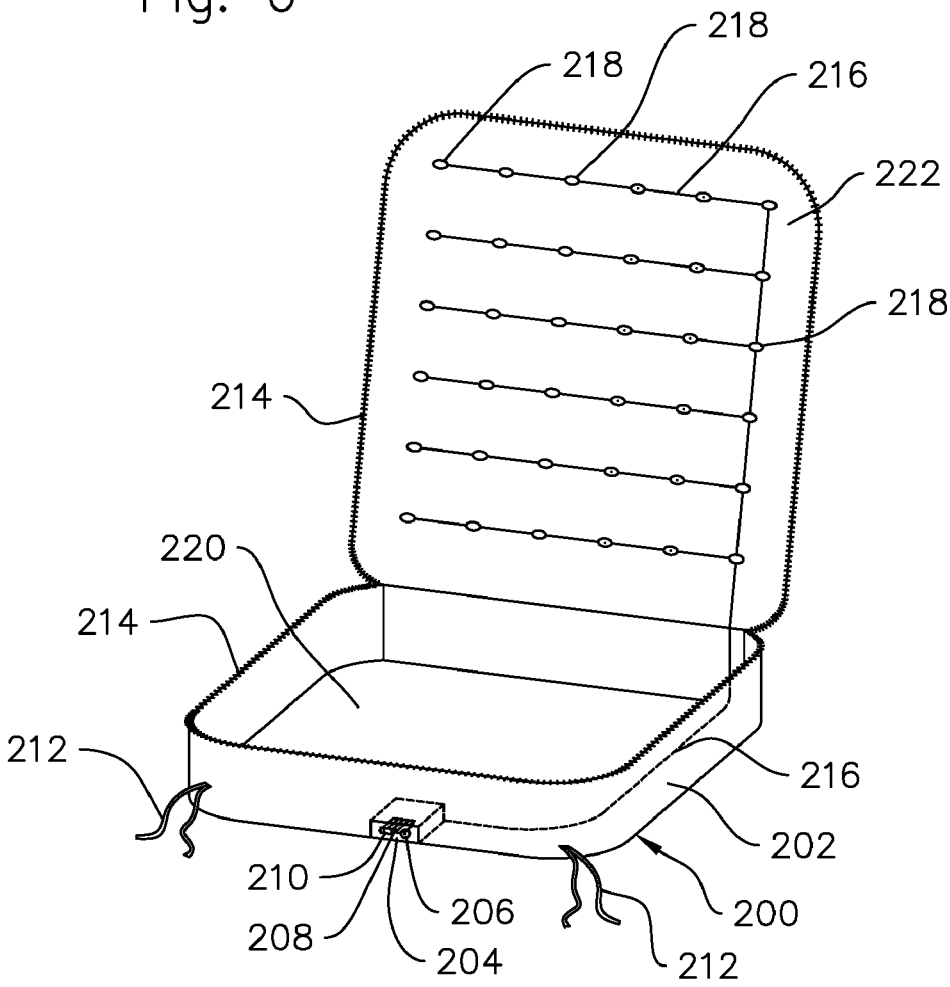
FIG. 7 is a perspective view of an embodiment of a lighted cushion cover, shown without a cushion.

FIG. 7 shows a cover assembly 200 comprised of, inter alia, a side panel 202, a console 204, a switch 206, a battery 208, a switch 210, straps 212, a zipper 214, wires 216, light emitting diodes (LEDs) 218, bottom panel 220 and a top panel 222. A typical use of said cover assembly 200 employs a common cushion (for example, foam rubber, air bladder or other cushioning material) that is placed inside the cover assembly 200, closed by means of a zipper 214 (or other suitable closing means such as ties, magnets, hook and loop, tape, adhesive or other commonly used means) and is placed on surface intended to be used as a seat and provides, inter alia, a cushioning function. The lighted cushion cover may be dimensioned to fit onto any shaped seat, for example, rounded for a stool, substantially square for a chair, rectangular to be a couch or bench cushion or any other shape to conform to the dimensions of a surface to be sat upon.

Said top panel 222 is preferably constructed of a flexible material that permits at least some of the light generated by the LEDs 218 to penetrate the top panel 222 and be visible from outside of the cover assembly 200 when closed. For example, said top panel 222 could be made of a transparent plastic, thin fabric or other light penetrable material. Said side panel 202 and bottom panel 220 may optionally be constructed of the same material as the top panel 222 but may also be made of an alternate flexible and durable material such as, for example, cloth, leather or plastic. Said straps 212 are positioned and dimensioned to be able to tie the cover assembly 200 to a chair or other seating surface onto which the cover assembly 200 is placed for use.

Generally, said LEDs 218 and wires 216 are affixed to the underside of the top panel 222 so that they are inside of the cushion assembly 200 during use. One or multiple LEDs 218 are affixed to the top panel 222 in a predetermined pattern, for example a grid, concentric rings, arcs, an icon or image or any other two dimensional design. Said LEDs 218 and wires 216 may be secured to said top panel 222 by stitches, adhesive or any other means to maintain the relative position of the LEDs 218 and wires 216 on the top panel 222. Optionally, said top panel 222 may have a reflective coating fitted under the LEDs 218 to reflect light emitted by the LEDs 218 through the top panel 222.

Affixed to said bottom panel 220 are, inter alia, said wires 216 and console 204. Said console 204 further comprises a battery 208, switch 206 and switch 210. Said switch 206 turns the electrical circuit on and off and said switch 210, optionally present, adjustably varies the current passing through the wires 216 and LEDs 218 to produce an effect such as varying the color or intensity of light produced by the LEDs 218, patterns of illumination or other similar effects. Said wires 216 connect the LEDs 218 to each other and to the console 204. Optionally, alternate means to generate light, other than the LEDs 218, may be used and examples could include incandescent lights, florescent lights, phosphorescent lights or any other light technology that is suitable to be used to produce light as a part of the cover assembly 200. In some applications of the cover assembly it may be preferable to substitute said battery 208 with a hard-wired electrical source such as a common household wall power receptacle to avoid the necessity of periodically replacing said battery 208.

Figure 8:
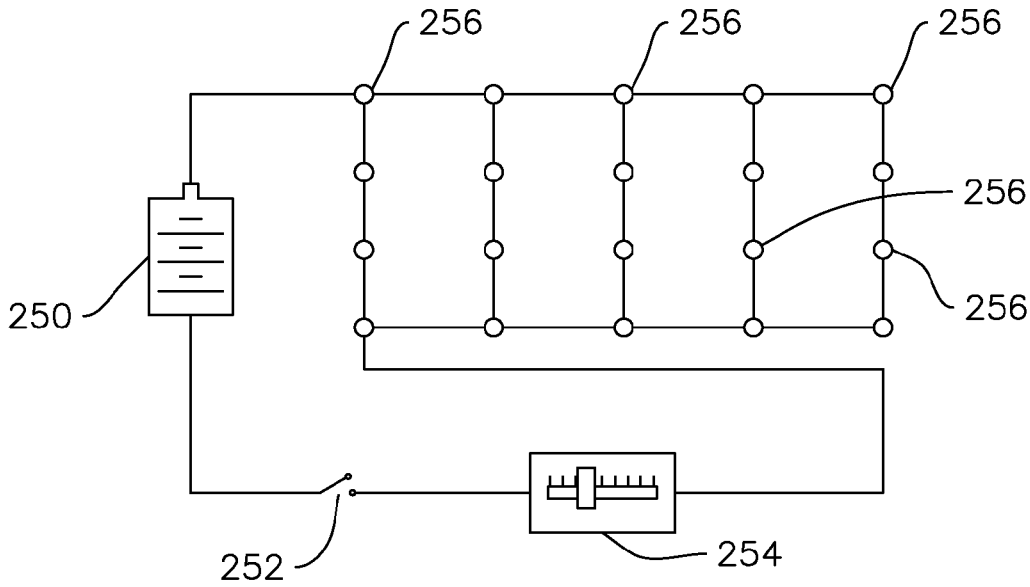
FIG. 8 is a sample circuit diagram.

FIG. 8 represents a sample of a wiring diagram that may be employed in any of the variations or embodiments of lighted cushions or cover assemblies disclosed herein and comprises, inter alia, a battery 250, a switch 252, a switch 254 and light emitting diodes (LEDs) 256. Said switch 252 completes a circuit and turns the circuit on or off. Said switch 254, optionally present, adjustably varies the power passing through the circuit and LEDs 256 to produce an effect such as varying the color or intensity of light produced by the LEDs 256, patterns of illumination or other similar effects. Said LEDs 256 are optionally wired in parallel or series. Optionally, alternate means to generate light, other than the LEDs 256, may be used and examples could include incandescent lights, florescent lights, phosphorescent lights or any other light technology that is suitable to produce light. In some applications of the lighted cushion it may be preferable to substitute said battery 250 with a hard-wired electrical source such as a common household wall power receptacle to avoid the necessity of periodically replacing said battery 250.

Figure 9:
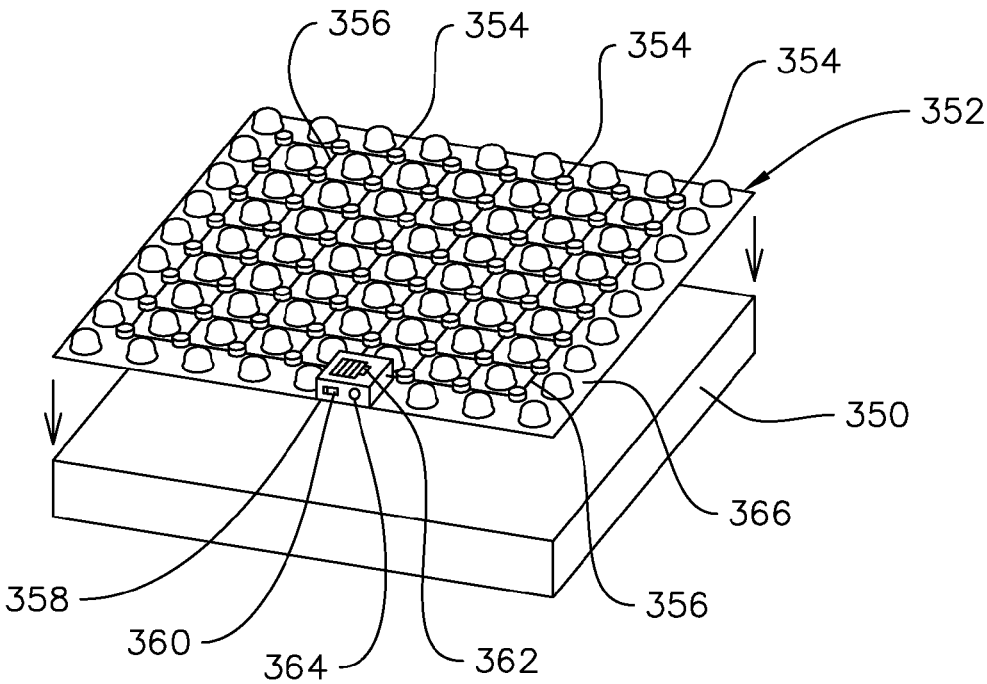
FIG. 9 is a perspective view of an embodiment of a lighted cushion.

Now referring to FIG. 9 where an embodiment of a lighted cushion is shown to comprise, inter alia, a pad 350, a light assembly 352, light emitting diodes (LEDs) 354, wires 356, a console 358, a switch 360, a battery 362, a switch 364 and a substrate 366. The combination of said pad 350 and light assembly 352, among the other various components, is typically placed on surface intended to be used as a seat and provides, inter alia, a cushioning function. The lighted cushion may be dimensioned to fit onto any shaped seat, for example, rounded for a stool, substantially square for a chair, rectangular to be a couch or bench cushion or any other shape to conform to the dimensions of a surface to be sat upon.

Optionally, the entire lighted cushion shown in FIG. 9 may be placed inside of a cover to protect it. An example of a cover is shown in FIG. 3. If a cover is used it is preferably constructed of a material transparent enough to permit light to pass through it, for example a transparent plastic or thin fabric.

Generally, said light assembly 352 is situated on top of said pad 350. In this embodiment said substrate 366 may be constructed from an encapsulated air cell sheet (colloquially referred to as "bubble wrap") that can secure the position of said LEDs 354, wires 356 and console 358 and provides some degree of cushioning itself. Said light assembly 352 may be transparent or opaque and may have a reflective coating between the pad 350 and the LEDs 354 to reflect any light emitted by the LEDs 354 away from the pad 350.

Integral to said light assembly 352 are, inter alia, said LEDs 354, wires 356 and console 358. Said console 358 further comprises a battery 362, switch 364 and switch 360. One or multiple LEDs 354 are affixed to the substrate 366 in a predetermined pattern, for example a grid, concentric rings, arcs, an icon or image or any other two dimensional design. In this embodiment of the light assembly 352 said switch 364 turns the electrical circuit on and off and said switch 360, optionally present, adjustably varies the current passing through the wires 356 and LEDs 354 to produce an effect such as varying the color or intensity of light produced by the LEDs 354, patterns of illumination or other similar effects. Said wires 356 connect the LEDs 354 to each other and to the console 358. Optionally, alternate means to generate light, other than the LEDs 354, may be used and examples could include incandescent lights, florescent lights, phosphorescent lights or any other light technology that is suitable to be used to produce light as a part of the lighted cushion. In some applications of the lighted cushion it may be preferable to substitute said battery 362 with a hard-wired electrical source such as a common household wall power receptacle to avoid the necessity of periodically replacing said battery 362.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lighted cushion comprising:

a) A bottom layer of pad dimensioned in a first axis and second axis to fit a corresponding first axis and second axis of a predetermined seating surface and said bottom layer of pad having a predetermined thickness;

b) A middle layer comprising one or more lights fixed in a pre-determined position onto a substrate dimensioned approximately equal to said first axis and said second axis of said bottom layer of pad; said lights are connected in a circuit to a power supply and a switch by wires; said switch having a first position and a second position; when said switch is in said first position then said switch is open or when said switch is in said second position the circuit is completed and power from said power supply flows through said wires and into said lights causing said lights to illuminate;

c) A top layer of pad dimensioned approximately equal to said first axis and said second axis of said bottom layer of pad and having a predetermined thickness; said top layer of pad being translucent enough to permit visible light produced from said lights to penetrate from said middle layer through the thickness of said top layer of pad.

2. A lighted cushion as set forth in claim 1 further characterized in that said power supply is comprised of a battery or alternating current.

3. A lighted cushion as set forth in claim 1 further comprising a reflective layer between said bottom layer of pad and said middle layer.

4. A lighted cushion as set forth in claim 1 further characterized in that said circuit further comprises a switch that controls the color, intensity and/or illumination patterns of said lights.

5. A lighted cushion as set forth in claim 1 further characterized in that said lights are selected from the group of light emitting diodes, fluorescent, phosphorescent or incandescent lights.

6. A lighted cushion as set forth in claim 1 further characterized in that said top layer is selected from the group of translucent foam, transparent foam, sheet of encapsulated air cells, silicone, plastic, air bladder or fluid filled bladder.

7. A lighted cushion comprising:

a) A bottom layer of pad dimensioned in a first axis and second axis to fit a corresponding first axis and second axis of a predetermined seating surface and said bottom layer of pad having a predetermined thickness;

b) A top layer comprising one or more lights fixed in a pre-determined position onto a substrate dimensioned approximately equal to said first axis and said second axis of said bottom layer of pad; said lights are connected in a circuit to a power supply and a switch by wires; said switch having a first position and a second position; when said switch is in said first position then said switch is open or when said switch is in said second position the circuit is completed and power from said power supply flows through said wires and into said lights causing said lights to illuminate.

8. A lighted cushion as set forth in claim 7 further characterized in that said power supply is comprised of a battery or alternating current.

9. A lighted cushion as set forth in claim 7 further comprising a reflective layer between said bottom layer of pad and said top layer.

10. A lighted cushion as set forth in claim 7 further characterized in that said circuit further comprises a switch that controls the color, intensity and/or illumination patterns of said lights.

11. A lighted cushion as set forth in claim 7 further characterized in that said lights are selected from the group of light emitting diodes, fluorescent, phosphorescent or incandescent lights.

12. A lighted cushion cover comprising:

a) A bottom panel dimensioned in a first axis and second axis to fit a corresponding first axis and second axis of a predetermined seating surface;

b) A top panel dimensioned approximately equal to said first axis and said second axis of said bottom panel; one or more lights fixed in a pre-determined position onto said top panel; said lights connected in a circuit to a power supply and a switch by wires; said switch having a first position and a second position; when said switch is in said first position then said switch is open or when said switch is in said second position the circuit is completed and power from said power supply flows through said wires and into said lights causing said lights to illuminate;

c) A side panel affixed to said bottom panel around the periphery of said bottom panel; said side panel having a height approximately equal to the thickness of a cushion;

said side panel removably connected to said top panel.

13. A lighted cushion cover as set forth in claim 12 further characterized in that said power supply is comprised of a battery or alternating current.

14. A lighted cushion cover as set forth in claim 12 further characterized in that said circuit further comprises a switch that controls the color, intensity and/or illumination patterns of said lights.

15. A lighted cushion cover as set forth in claim 12 further characterized in that said lights are selected from the group of light emitting diodes, fluorescent, phosphorescent or incandescent lights.

* * * * *